US005723185A

United States Patent [19]

Beier et al.

[11] Patent Number: 5,723,185

[45] Date of Patent: Mar. 3, 1998

[54] METHOD AND APPARATUS FOR APPLYING ADHESIVE

[76] Inventors: Michael Beier, 1028 Prospect, Elgin, Ill. 60120; Michael Ulane, 102 Willow Rd., Prospect Heights, Ill. 60070

[21] Appl. No.: 572,572

[22] Filed: Dec. 14, 1995

[51] Int. Cl.[6] ..... B05D 1/28

[52] U.S. Cl. ..... 427/429; 15/245; 15/245.1; 36/67 A

[58] Field of Search ..... 15/245, 245.1; 36/67 A; 427/429

[56] References Cited

U.S. PATENT DOCUMENTS 3,611,470 10/1971 Gaston ..... 15/245.1 X
4,667,422 5/1987 Yamaguchi ..... 36/67 A
4,982,470 1/1991 Szabo ..... 15/245.1
4,993,174 2/1991 Yamada et al. ..... 36/67 A

*Primary Examiner*—Michael Lusignan
*Attorney, Agent, or Firm*—Kajane McManus

[57] ABSTRACT

The method of applying adhesive to a substrate is performed by an installer donning a pair of shoes having pins extending from the undersurface thereof and using a notched spreading edge squeegee having an elongate handle to push adhesive from the configuration of a puddle to a configuration of parallel spaced apart lines of adhesive, the installer being capable of walking forwardly being the squeegee and further being capable of walking across the lines of adhesive without adversely affecting desired quality of adhesion.

4 Claims, 1 Drawing Sheet

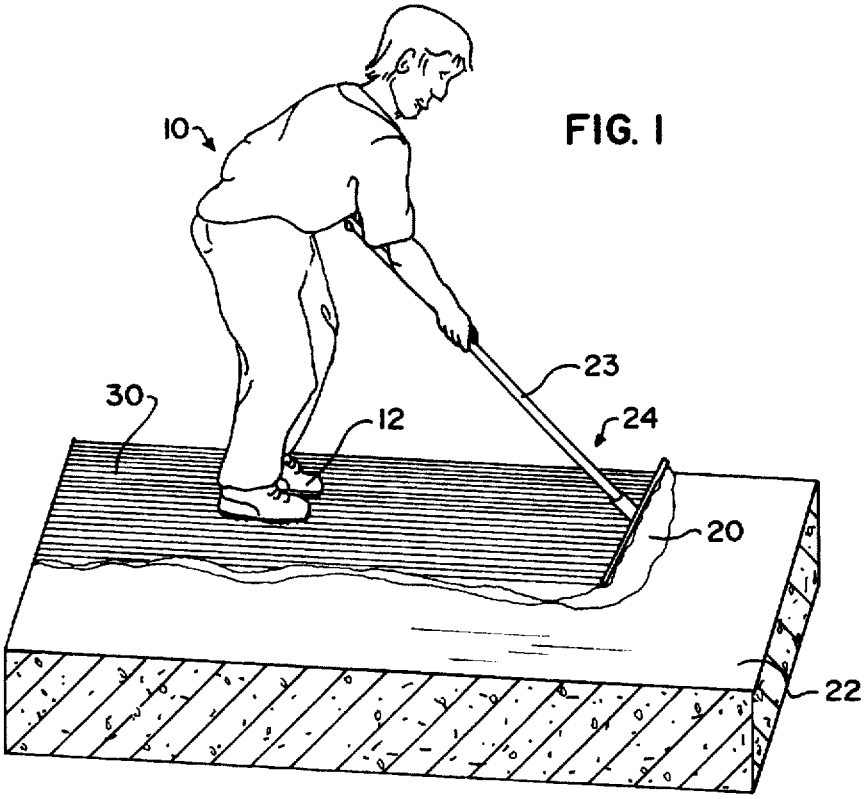
FIG. 1
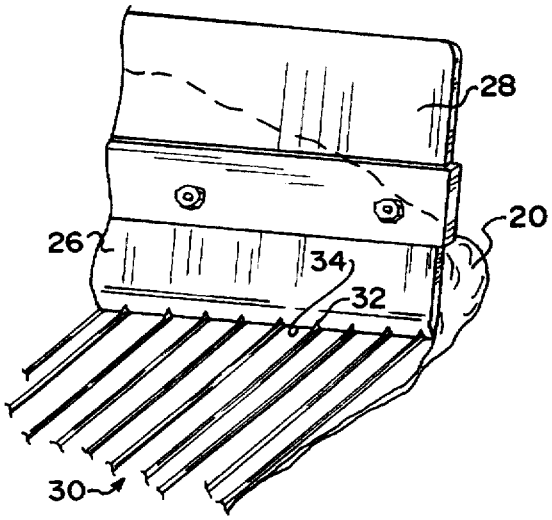
FIG. 2
FIG. 3
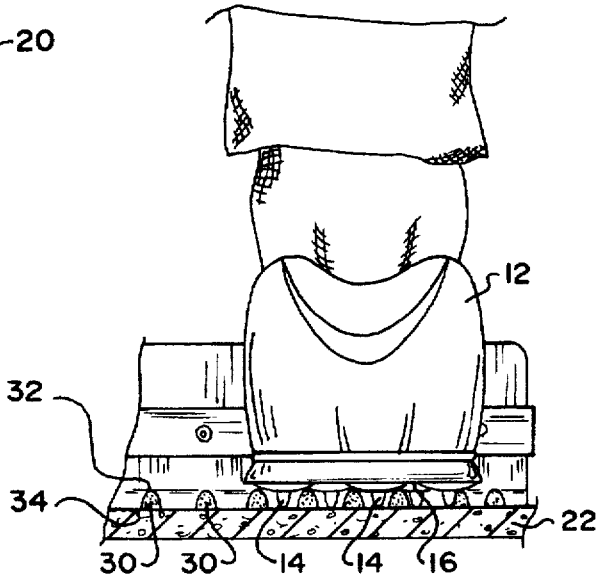

METHOD AND APPARATUS FOR APPLYING ADHESIVE

BACKGROUND OF THE INVENTION

1. Field of the Invention

The present invention relates to a method of applying an adhesive and to the apparatus used in the method. More specifically, the method relates to applying adhesive for use in fixing a floor covering to a substrate and to apparatus which allows for the method to be practiced with the installer being able to stand while applying the adhesive.

2. Prior Art

Heretofore the process of adhesively fixing flooring, such as a carpet, to a substrate, such as a floor has been a tedious and time consuming task requiring much labor on the part of the installer.

Presently, an installer is required to kneel and use a hand trowel to pull adhesive toward himself from a puddle of adhesive poured onto the substrate. The installer must then work backward on hands and knees and cannot cover large areas quickly or efficiently working in this position. Further, he must work in a specific direction, backward, which will allow him to escape the area without requiring him to cross over applied adhesive, disturbing the desired pattern of adhesive application.

In the carpet laying industry, the adhesive is typically placed in a form to create small, narrowly spaced apart parallel lines of adhesive so that the carpet to be laid thereover is fixed at all points therealong to the substrate, the parallel lines of adhesive spreading toward one another and merging under the weight of the carpet. Too much adhesive, as well as too little, would cause problems in professional finishing, as is known.

SUMMARY OF THE INVENTION

Accordingly it is a primary object of the invention to provide a method and apparatus which provide quick and easy adhesive application, in the proper form, and which will allow of the installer freedom of movement by walking the application on, as well as allowing the installer to be able to cross over areas where the adhesive has already been applied with only minimal disturbance to the desired pattern of application.

These and other objects are met by the method and apparatus of the present invention wherein the installer wears shoes having pins extending from the underside thereof which elevate the feet above the height to which the adhesive is applied and pushing the adhesive across the substrate using a long handled squeegee which is notched to create parallel lines of adhesive while walking forwardly behind the squeegee.

BRIEF DESCRIPTION OF THE DRAWINGS

FIG. 1 is a perspective view of an installer spreading adhesive across a substrate using the method and apparatus of the present invention.

FIG. 2 is an enlarged view of one edge of the squeegee showing same creating parallel lines of adhesive from a puddle of adhesive.

FIG. 3 is an enlarged view showing an installers foot behind the squeegee and elevated above the lines of adhesive being formed by the method.

DESCRIPTION OF THE PREFERRED EMBODIMENT

Referring now to the drawings in greater detail there is illustrated therein the method of spreading adhesive on a substrate according to the method of the present invention, using the apparatus of the present invention.

As shown, an installer 10 first dons a pair of shoes 12 which have a plurality of pins 14 extending from an underside 16 thereof. Such pins 14 must be of a length sufficient to elevate the installer 10 above the desired thickness of the adhesive layer to be laid down. In empirical testing it was found that golf shoes 12 may be used, the pins 14 on the undersurface 16 elevating the installer 10 to such a height where the undersurface 16 does not come into contact with the adhesive to be applied.

The installer then pours a puddle of adhesive 20 on a substrate 22, such as a floor 22, upon which the adhesive 20 is to be spread.

Next the installer 10 grasps the handle 23 of the applicator 24 which has a notched spreading edge squeegee 26 mounted to the handle 23 and includes a detachable overflow shield 28 seated above and across the extent of the squeegee 26.

The installer 10 then places the squeegee 26 adjacent a puddle of adhesive 20 and pushes the squeegee 26 forwardly, ahead of himself, through manipulation of the handle 23.

When contact is made with the puddle of adhesive 20, the adhesive 20 may rise above the level of the squeegee 26 because of its density and would spill over behind the squeegee 20 if the overflow shield 28 were not provided.

As stated previously, the adhesive 20 is preferably applied in the configuration of multiple parallel lines 30. Such configuration is provided by creating notches 32 in the spreading edge 34 of the squeegee 26. Thus, the adhesive 20 flows through the notches 32 while the remainder of the spreading edge 34 engages against and scrapes the substrate substantially free of adhesive 20, creating the desired configuration of multiple parallel lines 30 of adhesive 20.

Inasmuch as the shoes 12 elevate the installer 20 above the level to which the lines 30 of adhesive 20 rise from the substrate 22, the installer 10 may walk behind the squeegee 26, pushing same forwardly, creating only a minimal disturbance in the lines 30 of adhesive 20 where the pins 14 of the shoes 12 come into contact with the adhesive 20. Such minimal disturbance has not been found to have any adverse effects in uniformity of binding to the substrate 22.

It will be understood that the ability of walking across the substrate 22 together with the capability of using a very wide squeegee 26 in the method creates significant decrease in manpower and time required to spread adhesive 20. It has been found that a job which would typically take an installer 10 twenty hours to perform can now be accomplished by the installer 10 in about ten hours. Further, because the installer 10 is now capable of carefully walking across the applied adhesive, backward application and the inability to cross the area to which the adhesive 20 has been applied are no longer a problem.

As described above, the method and apparatus of the present invention provide a number of advantages some of which have been described above and some of which are inherent in the invention. Also, modifications may be proposed to the method and apparatus without departing from the teachings herein. Accordingly the scope of the invention is only to be limited by the accompanying claims.

We claim:

1. A method of applying adhesive to a substrate by an installer, the method comprising the steps of:

the installer donning a pair of shoes having pins extending from the undersurface thereof;

the installer pouring a puddle of adhesive onto a substrate which is to be coated with the adhesive; and the installer using a notched spreading edge squeegee having a long handle to push adhesive from the puddle to a configuration of parallel, spaced apart lines of adhesive.

2. The method of claim 1 wherein the installer walks forwardly behind the squeegee pushing the squeegee ahead of him.

3. The method of claim 1 wherein the installer walks across the lines of adhesive without adversely affecting the configuration of the lines of adhesive.

4. A wide, notched spreading edge squeegee having an elongate handle and further having a detachable overflow shield engaged along the width of a top edge of the squeegee.

* * * * *